US009119447B2

(12) United States Patent
Demetriou et al.

(10) Patent No.: US 9,119,447 B2
(45) **Date of Patent: *Sep. 1, 2015**

(54) AMORPHOUS PLATINUM-RICH ALLOYS

(71) Applicant: California Institute of Technology, Pasadena, CA (US)

(72) Inventors: Marios D. Demetriou, West Hollywood, CA (US); William L. Johnson, San Marino, CA (US)

(73) Assignee: California Institute of Technology, Pasadena, CA (US)

( * ) Notice: Subject to any disclaimer, the term of this patent is extended or adjusted under 35 U.S.C. 154(b) by 245 days.

This patent is subject to a terminal disclaimer.

(21) Appl. No.: 13/752,615

(22) Filed: Jan. 29, 2013

(65) Prior Publication Data

US 2013/0139931 A1 Jun. 6, 2013

Related U.S. Application Data

(63) Continuation of application No. 12/705,526, filed on Feb. 12, 2010, now Pat. No. 8,361,250.

(60) Provisional application No. 61/207,598, filed on Feb. 13, 2009.

(51) Int. Cl.

| | |
|---|---|
| ***C22C 5/04*** | (2006.01) |
| ***C22C 45/00*** | (2006.01) |
| ***A44C 27/00*** | (2006.01) |
| ***C22C 1/00*** | (2006.01) |

(52) U.S. Cl.

CPC ..... *A44C 27/003* (2013.01); *C22C 1/002* (2013.01); *C22C 5/04* (2013.01); *C22C 45/003* (2013.01)

(58) Field of Classification Search

None

See application file for complete search history.

(56) References Cited

U.S. PATENT DOCUMENTS

| | | | | |
|---|---|---|---|---|
| 4,175,950 | A * | 11/1979 | Linares et al. | 75/10.15 |
| 4,781,803 | A | 11/1988 | Harris et al. | |
| 6,695,936 | B2 * | 2/2004 | Johnson | 148/508 |
| 8,066,827 | B2 | 11/2011 | Demetriou et al. | |
| 8,361,250 | B2 | 1/2013 | Demetriou et al. | |
| 2003/0000601 | A1 * | 1/2003 | Shimizu et al. | 148/403 |
| 2006/0124209 | A1 | 6/2006 | Schroers et al. | |
| 2006/0157164 | A1 | 7/2006 | Johnson et al. | |
| 2009/0236494 | A1 | 9/2009 | Hata et al. | |

FOREIGN PATENT DOCUMENTS

| | | |
|---|---|---|
| CN | 101191184 | 6/2008 |

OTHER PUBLICATIONS

U.S. Appl. No. 14/667,191, filed Mar. 24, 2015, Na et al.

* cited by examiner

*Primary Examiner* — George Wyszomierski

(74) *Attorney, Agent, or Firm* — Polsinelli PC

(57) ABSTRACT

According to embodiments of the present invention, an amorphous alloy includes at least Pt, P, Si and B as alloying elements, and has a Pt weight fraction of about 0.925 or greater. In some embodiments, the Pt weight fraction is about 0.950 or greater.

20 Claims, 3 Drawing Sheets

AMORPHOUS PLATINUM-RICH ALLOYS

CROSS-REFERENCE TO RELATED APPLICATION(S)

This application is a continuation of U.S. patent application Ser. No. 12/705,526, entitled "Amorphous Platinum-Rich Alloys", filed on Feb. 12, 2010, now U.S. Pat. No. 8,361,250, which is incorporated by reference in its entirety as if fully disclosed herein.

This application claims priority to and the benefit of U.S. Provisional Application Ser. No. 61/207,598, filed on Feb. 13, 2009, and titled "Amorphous Pt-based alloys with a Pt weight fraction of 0.950 for platinum jewelry applications," the entire content of which is incorporated herein by reference.

FIELD OF THE INVENTION

The invention relates generally to amorphous platinum-rich alloys and to three-dimensional objects formed from the amorphous platinum-rich alloys.

BACKGROUND OF THE INVENTION

Platinum is a noble metal used in the production of fine jewelry. As with many other precious metals, platinum ("Pt") typically is alloyed with other elements prior to being made into jewelry. Amorphous Pt-based alloys, or Pt-based glasses, are of particular interest for jewelry applications. The disordered atomic-scale structure of amorphous Pt-based alloys gives rise to hardness, strength, elasticity, and corrosion resistance that is improved over conventional (crystalline) Pt-based alloys. In addition, amorphous Pt-based alloys exhibit desirable processability characteristics due to their ability to soften and flow when heated above their glass transition temperature ($T_g$).

Hard Pt-based alloys are desirable as they are more scratch resistant, and maintain a brilliant finish, even after heavy use. Soft Pt-based alloys may become dull after shorter periods of use. The hardness of the Pt alloy may depend on its composition. In addition to hardness, the composition of the alloy may influence the critical casting thickness for glass formation, which is a measure of the thickness of the material that can be produced while retaining its amorphous atomic structure and associated properties. Alloys having a suitable critical casting thickness are typically prepared by way of rapid cooling. To obtain a material with a desirable Pt content and suitable size dimensions, the composition of the material can be tailored to produce an amorphous material with standard available cooling techniques. The higher the critical casting thickness attained with standard available cooling techniques, the more processable the alloy becomes. Alloys capable of producing amorphous objects that are thick (thicker than 1.0 mm) with standard available cooling techniques are referred to as bulk metallic glasses.

Pt-based jewelry alloys typically contain Pt at weight percentages of less than 100%. Hallmarks are used by the jewelry industry to indicate the metal content, or fineness, of a piece of jewelry by way of a mark, or marks, stamped, impressed, or struck on the metal. These marks may also be referred to as quality or purity marks. Although the Pt content associated with a hallmark varies from country to country, Pt weight fractions of about 0.850, about 0.900, and about 0.950 are commonly used in platinum jewelry. Alloys containing a Pt weight fraction of about 0.950 are referred to as "pure platinum," and command higher prices than alloys containing about 0.800, about 0.850, or even about 0.900 Pt weight fractions. It is therefore desirable to produce an amorphous Pt-based alloy having a Pt weight fraction of about 0.950.

SUMMARY

One embodiment of the present invention is directed to amorphous alloys including at least Pt, phosphorus ("P"), silicon ("Si"), and boron ("B") as alloying elements, wherein the Pt is present in the alloy at a weight fraction of about 0.925 or greater.

Another embodiment of the present invention is directed to three-dimensional objects formed from amorphous alloys including at least Pt, P, Si and B as alloying elements, wherein the Pt is present in the alloy at a weight fraction of about 0.925 or greater.

BRIEF DESCRIPTION OF THE DRAWINGS

These and other features and advantages of the present invention will be better understood by reference to the following detailed description when considered in conjunction with the attached drawings, in which.

DETAILED DESCRIPTION

Figure 1A:
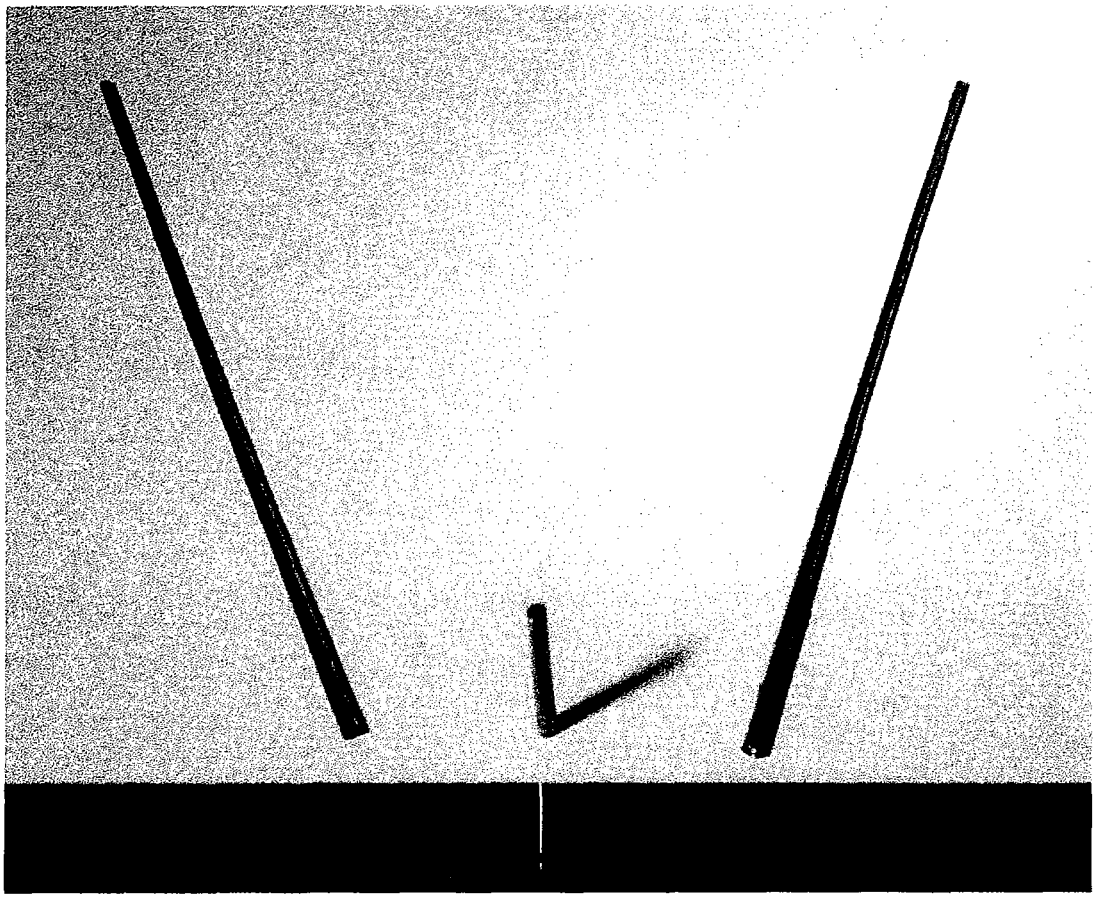
FIG. 1A is a photograph of amorphous $Pt_{0.747}Cu_{0.015}Ag_{0.003}P_{0.18}B_{0.04}Si_{0.015}$ rods, 1.7 mm in diameter, produced as in Example 21.

In the following detailed description, only certain exemplary embodiments of the present invention are shown and described, by way of illustration. As those skilled in the art would recognize, the invention may be embodied in many different forms and should not be construed as being limited to the embodiments set forth herein. Like reference numerals designate like elements throughout the specification.

It is desirable to produce a Pt-based alloy that is both amorphous and has a high Pt content. Amorphous Pt-based alloys having a high Pt content and a critical casting thickness suitable for the production of hallmarked Pt jewelry are particularly desirable. Production of Pt-rich alloys may require, however, an optimization process that will determine the greater glass-forming ability and critical casting thickness for a desired Pt content. This is because increasing the Pt content of the alloy reduces the chemical and topological interactions with other elements in a manner that may diminish the glass-forming ability and drastically decrease the critical casting thickness of the alloy. While decreasing the Pt content of the alloy may improve glass forming ability and increase the critical casting thickness of the alloy, if the Pt content is not as high as a required hallmarked content, the alloy may not be suitable for jewelry or other applications that carry that hallmark. Embodiments of the present invention overcome these difficulties.

Although Pt-based alloys with Pt weight fractions of about 0.850 have been produced, alloys with higher Pt weight fractions, and in particular, alloys with Pt weight fractions above about 0.910 have not been produced. For example, U.S Patent Publication No. 2006/0124209, J. Schroers, "Highly Processable Bulk Metallic Glass-Forming Alloys in the Pt—Co—Ni—Cu—P System," Applied Physics Letters, 84(18) (2004) 3666-3668, and J. Schroers, "Precious Bulk Metallic Glasses for Jewelry Applications," Materials Science & Engineering A, 449-451 (2007) 235-238, the entire contents of each of which are incorporated herein by reference, appear to disclose an amorphous Pt-based alloy with a Pt weight fraction of about 0.850. The highest Pt-content exemplary alloy reported in those references appears to be an alloy with a Pt-weight fraction of 0.907. In attempting to make a bulk-glass-forming alloy with a higher Pt-content by the methods described by Schroers, the inventors of the present application were unable to make an alloy having a Pt content of 0.925 or higher capable of forming amorphous objects thicker than 0.5 mm using standard available cooling techniques. However, embodiments of the present invention achieve Pt weight fractions of about 0.925 or greater.

According to some embodiments of the present invention, an amorphous alloy has at least platinum (Pt), phosphorus (P), silicon (Si), and boron (B) as alloying elements. The Pt is present in the alloy at a weight fraction of about 0.925 or greater. For example, in some embodiments, the alloy has a Pt weight fraction of about 0.950 or greater. The weight fraction of Pt in the alloy is calculated from knowledge of the atomic fractions and molecular weights of all constituent elements in the alloy composition. As such, in order to calculate the weight fraction of Pt in the alloy, the complete alloy composition including the atomic fractions of all constituent elements must be known.

The inclusion in the amorphous Pt-based alloys of P, B and Si (which are non-metals and metalloids) enables good glass forming ability while retaining relatively high Pt weight fractions. Specifically, the combination of P, B and Si in proper fractions with high contents of Pt results in certain chemical and topological interactions that are uniquely suitable for bulk-glass formation. If one or more of P, B and Si is omitted, the interactions of the remaining elements with high contents of Pt are not sufficient to enable bulk-glass formation. To date, no published reference appears to teach or suggest that all three of P, B, and Si must coexist with Pt in order to achieve bulk-glass formation with alloys containing Pt at weight fractions of 0.925 or higher. Specifically, although the Schroers references may disclose a method of making an alloy having a Pt weight fraction of about 0.850 (and perhaps up to 0.910), those references do not appear to disclose bulk-glass-forming alloys with higher Pt weight fractions nor a method of making such alloys. Indeed, the inventors of the present application were unable to make alloys with Pt weight fractions of 0.925 or higher capable of forming amorphous objects with thicknesses of 0.5 mm or greater according to the methods described in the Schroers references. However, according to embodiments of the present invention, the alloys maintain good glass forming ability, as evidenced by their critical casting thicknesses that equal or exceed 0.5 mm. The alloys of the present invention also achieve Pt contents meeting or exceeding the highest jewelry hallmarks (e.g., a Pt weight fraction of 0.95), making them suitable for jewelry and other applications carrying a high Pt-content hallmark. This has been achieved, in some embodiments, by combining Pt with all three of P, B and Si in unique atomic fractions.

P, Si and B can be present in the alloy in any suitable amount so long as the Pt weight fraction is about 0.925 or greater. In some embodiments of the present invention, the atomic fraction of P may be from about 0.10 to about 0.20. For example, in some embodiments, the atomic fraction of P is about 0.18.

In some embodiments, the atomic fraction of B may be from about 0.01 to about 0.10. For example, in some embodiments, the atomic fraction of B may be 0.04.

In some embodiments, the atomic fraction of Si may be from about 0.005 to about 0.05. For example, in some embodiments, the atomic fraction of Si may be about 0.015.

According to other embodiments of the present invention, the amorphous alloy having at least Pt, P, Si, and B as alloying elements, further includes one or more additional alloying elements. Nonlimiting examples of suitable elements for the additional alloying element(s) include Cu, Ag, Ni, Pd, Au, Co, Fe, Ru, Rh, Ir, Re, Os, Sb, Ge, Ga, Al, and combinations thereof. The atomic concentration of the additional alloying element(s) in the alloy should be such that the Pt weight fraction in the alloy is about 0.925 or greater, and is therefore dictated by the atomic concentration of the remaining alloying elements (i.e., P, Si and B).

The amorphous alloy may also include additional alloying elements, or impurities, in atomic fractions of about 0.02 or less.

According to still other embodiments of the present invention, the amorphous alloy having at least Pt, P, Si and B as alloying elements further includes Cu as an alloying element. The concentration of Cu in the alloy should be such that the Pt weight fraction in the alloy is about 0.925 or greater, and is therefore dictated by the concentration of the remaining alloying elements (i.e., P, Si and B). In some embodiments, for example, the atomic fraction of Cu is about 0.015 to about 0.025, the atomic fraction of P is about 0.15 to about 0.185, the atomic fraction of B is about 0.02 to about 0.06, and the atomic fraction of Si is about 0.005 to about 0.025. In one exemplary embodiment where the Pt weight fraction is 0.950 and the atomic concentrations of P, B, and Si are 0.18, 0.04, and 0.015, respectively, the atomic fraction of Cu is 0.02.

According to yet other embodiments of the present invention, the amorphous alloy having at least Pt, P, Si and B as alloying elements further includes Cu and Ag as alloying elements. The atomic concentration of Cu and Ag in the alloy should be such that the Pt weight fraction in the alloy is about 0.925 or greater, and is therefore dictated by the atomic concentration of the remaining alloying elements (i.e., P, Si and B). In some exemplary embodiments, an atomic ratio of Cu to Ag present in the alloy is from about 2 to about 10. For example, in some embodiments, the atomic ratio of Cu to Ag in the alloy is about 5.

As noted above, the atomic concentration of Cu and Ag in the alloy depends on the atomic concentration of the remaining alloying elements, and is such that the Pt weight fraction is about 0.925 or greater. In some embodiments, for example, the atomic fraction of Cu is about 0.01 to about 0.02, the atomic fraction of Ag is about 0.001 to about 0.01, the atomic fraction of P is about 0.15 to about 0.185, the atomic fraction of B is about 0.02 to about 0.06, and the atomic fraction of Si is about 0.005 and 0.025. In one exemplary embodiment where the Pt weight fraction is 0.950 and the atomic concentrations of P, B, and Si are 0.18, 0.04, and 0.015, respectively, the atomic fractions of Cu and Ag are 0.015 and 0.003, respectively.

Nonlimiting examples of suitable amorphous alloys according embodiments of the present invention include $Pt_{0.765}P_{0.18}B_{0.04}Si_{0.015}$, $Pt_{0.745}Cu_{0.02}P_{0.18}B_{0.04}Si_{0.05}$, $Pt_{0.7435}Cu_{0.0215}P_{0.18}B_{0.04}Si_{0.0153}Pt_{0.7425}Cu_{0.0125}Ni_{0.01}P_{0.18}B_{0.04}Si_{0.015}$, $Pt_{0.7456}Cu_{0.0159}Ag_{0.0035}P_{0.18}B_{0.04}Si_{0.015}$, $Pt_{0.744}Cu_{6.015}Ni_{0.004}Ag_{0.002}P_{0.18}B_{0.04}Si_{0.015}$, $Pt_{0.745}Cu_{0.013}Ni_{0.003}Pd_{0.002}Ag_{0.002}P_{0.18}B_{0.04}Si_{0.015}$, $Pt_{0.747}Cu_{0.015}Ag_{0.003}P_{0.18}B_{0.04}Si_{0.015}$, $Pt_{0.71625}Cu_{0.0195}Ni_{0.0195}Pd_{0.004875}Ag_{0.004875}P_{0.18}B_{0.04}Si_{0.015}$, $Pt_{0.7}Cu_{0.055}Ag_{0.01}P_{0.18}B_{0.04}Si_{0.015}$, $Pt_{0.75}Cu_{0.05}P_{0.125}B_{0.05}Si_{0.025}$, $Pt_{0.75}Cu_{0.035}Ni_{0.015}P_{0.125}B_{0.05}Si_{0.025}$, $Pt_{0.75}Cu_{0.035}Pd_{0.015}P_{0.125}B_{0.05}Si_{0.025}$, $Pt_{0.75}Cu_{0.025}Ni_{0.02}Pd_{0.005}P_{0.125}B_{0.05}Si_{0.025}$, $Pt_{0.75}Cu_{0.025}Ni_{0.02}Cr_{0.005}P_{0.125}B_{0.05}Si_{0.025}$, $Pt_{0.75}Cu_{0.02}Ni_{0.02}Pd_{0.005}Ag_{0.005}P_{0.125}B_{0.05}Si_{0.025}$, $Pt_{0.75}Cu_{0.02}Ni_{0.02}Pd_{0.005}CO_{0.005}P_{0.125}B_{0.05}Si_{0.025}$, $Pt_{0.75}Cu_{0.015}Ni_{0.02}Pd_{0.005}Ag_{0.005}AU_{0.005}P_{0.125}B_{0.05}Si_{0.025}$, $Pt_{0.75}Cu_{0.015}Ni_{0.02}Pd_{0.005}Ag_{0.005}Fe_{0.005}P_{0.125}B_{0.05}Si_{0.025}$, $Pt_{0.73125}Cu_{0.0195}Ni_{0.0195}Pd_{0.004875}Ag_{0.004875}P_{0.115}B_{0.09}Si_{0.0155}$, $Pt_{0.73125}Cu_{0.0195}Ni_{0.0195}Pd_{0.004875}Ag_{0.004875}P_{0.1725}B_{0.02}Si_{0.0275}$, $Pt_{0.73125}Cu_{0.0195}Ni_{0.0195}Pd_{0.004875}Ag_{0.004875}P_{0.14}B_{0.04}Si_{0.041}$, $Pt_{0.73125}Cu_{0.0195}Ni_{0.0195}Pd_{0.004875}Ag_{0.004875}P_{0.17}B_{0.04}Si_{0.01}$, $Pt_{0.71125}Cu_{0.0195}Ni_{0.0195}Pd_{0.004875}Ag_{0.004875}P_{0.185}B_{0.04}Si_{0.015}$, and the like, wherein the subscripts denote approximate atomic fractions.

In some embodiments, for example, the amorphous alloy may be selected from $Pt_{0.765}P_{0.18}B_{0.04}Si_{0.01}$, $Pt_{0.745}Cu_{0.02}P_{0.18}B_{0.04}Si_{0.015}$, $Pt_{0.7435}Cu_{0.0215}P_{0.18}B_{0.04}Si_{0.015}$, $Pt_{0.7425}Cu_{0.0125}Ni_{0.01}P_{0.18}B_{0.04}Si_{0.015}$, $Pt_{0.745}Cu_{0.0159}Ag_{0.0035}P_{0.18}B_{0.04}Si_{0.015}$, $Pt_{0.744}Cu_{0.015}Ni_{0.004}Ag_{0.002}P_{0.18}B_{0.04}Si_{0.015}$, $Pt_{0.745}Cu_{0.013}Ni_{0.003}Pd_{0.002}Ag_{0.002}P_{0.18}B_{0.04}Si_{0.015}$, $Pt_{0.747}Cu_{0.015}Ag_{0.003}P_{0.18}B_{0.04}Si_{0.015}$, $Pt_{0.71625}Cu_{0.0195}Ni_{0.0195}Pd_{0.004875}Ag_{0.004875}P_{0.18}B_{0.04}Si_{0.015}$, $Pt_{0.7}Cu_{0.055}Ag_{0.01}P_{0.18}B_{0.04}Si_{0.015}$, and the like, wherein the subscripts denote approximate atomic fractions.

In other exemplary embodiments, the amorphous alloy may be selected from $Pt_{0.765}P_{0.18}B_{0.04}Si_{0.015}$, $Pt_{0.745}Cu_{0.02}P_{0.18}B_{0.04}Si_{0.015}$, $Pt_{0.747}Cu_{0.015}Ag_{0.003}P_{0.18}B_{0.04}Si_{0.015}$, and $Pt_{0.7}Cu_{0.055}Ag_{0.01}P_{0.18}B_{0.04}Si_{0.015}$, wherein the subscripts denote approximate atomic fractions.

The amorphous alloys according to embodiments of the present invention can be made by any suitable method so long as the resulting alloy has a Pt weight fraction of at least about 0.925. One exemplary method for producing such an amorphous alloy involves inductively melting the appropriate amount of the alloy constituents in a quartz tube under an inert atmosphere. However, larger quantities (greater than 5 grams) of the alloy may be produced by first producing a P-free pre-alloy by melting an appropriate amount of the alloy constituents (except for P) in a quartz tube under an inert atmosphere, and then adding P by enclosing it with the pre-alloy in a quartz tube sealed under an inert atmosphere. The sealed tube is then placed in a furnace and the temperature is increased intermittently in a stepwise manner until the P is completely alloyed.

The amorphous alloys according to embodiments of the present invention may be used to form three-dimensional bulk objects. An exemplary method of producing three-dimensional bulk objects having at least 50% (by volume) amorphous phase involves fluxing the alloy ingot by melting it in contact with de-hydrated $B_2O_3$ melt in a quartz tube under an inert atmosphere, and keeping the two melts in contact at a temperature about 100° C. above the alloy melting point for about 1000 s. Subsequently, while still in contact with a piece of molten de-hydrated $B_2O_3$, the melt is cooled from above the melting temperature to a temperature below the glass transition temperature at a rate sufficient to prevent the formation of more than 50% crystalline phase.

A fluxed ingot can be processed further into a three-dimensional bulk shape using several methods, including but not limited to: (i) heating the fluxed ingot to a temperature about 100° C. above the melting temperature under an inert atmosphere, and applying pressure to force the molten liquid into a die or a mold made of a high thermal conductivity metal such as copper or steel; (ii) heating the fluxed ingot to a temperature above the glass-transition temperature, applying pressure to form the viscous liquid into a net-shape or forcing it into a mold over a duration not exceeding the time to crystallize at that temperature, and subsequently cooling the formed object to below the glass-transition temperature.

The following examples are presented for illustrative purposes only and do not limit the scope of the present invention. In each of the examples, the alloys were prepared by the capillary water-quenching method. Elements with purities of about 99.9% or greater were used. Elements were weighed to within about 0.1% of the calculated mass, and were ultrasonically cleaned in acetone and ethanol prior to melting. Melting of the elements was performed inductively in a quartz tube sealed under a partial argon atmosphere. The alloyed ingots were subsequently fluxed with dehydrated $B_2O_3$. Fluxing was performed by inductively melting the ingots in contact with dehydrated $B_2O_3$ melt in quartz tubes under argon, holding the melted ingots at a temperature roughly 100 degrees above the alloy melting temperature for approximately 20 minutes, and finally water quenching the tubes containing the molten ingots. The fluxed ingots were subsequently re-melted and cast into glassy rods using quartz capillaries. The fluxed ingots were ultrasonically cleaned in acetone and ethanol and placed in quartz tubes connected to quartz capillaries. The capillaries were of various inner diameters, and had outer diameters that were about 20% larger compared to the corresponding inner diameters. The quartz tube/capillary containers containing the alloyed ingots were evacuated and placed in a furnace set at a temperature about 100° C. higher than the alloy melting temperature. After the alloy ingots were completely molten, the melt was injected into the capillaries using 1.5 atmospheres of argon. Finally, the capillary container containing the melt was extracted from the furnace and rapidly water quenched. The amorphous nature of the glassy rods was verified using at least one of the following methods: (a) x-ray diffraction (verification of the amorphous state if the diffraction pattern exhibits no crystalline peaks); (b) differential scanning calorimetry (verification of the amorphous state if the scan reveals a slightly endothermic glass relaxation event followed by an exothermic crystallization event upon heating from room temperature). The alloy compositions corresponding to the various Examples are shown in Table 1, and the compositions corresponding to the various Comparative Examples are shown in Table 2.

The alloys of the Examples and Comparative Examples in Tables 1 and 2 were formed into amorphous rods by water-quenching quartz capillaries containing the molten alloys having quartz wall thicknesses that vary according to the quartz diameter. Since quartz is known to be a poor heat conductor that retards heat transfer, the wall thickness of the quartz capillary used to cast a rod of a specific diameter is a critical parameter associated with the glass-forming ability of the exemplary alloys. The wall thicknesses of the quartz capillaries used to cast the rods of the present invention are about 10% of the capillary inner diameter. The critical rod diameters reported herein are thus associated with a cooling rate enabled by water-quenching quartz capillaries containing the molten alloy having wall thicknesses equivalent to about 10% of the corresponding rod diameter. The critical casting rod diameter (d) is tabulated for some exemplary alloys according to the present invention in Table 1, and for some comparative alloys in Table 2.

TABLE 1

| Example | Alloy Composition | Pt Weight Fraction | d [mm] |
|---|---|---|---|
| 1 | $Pt_{0.75}Cu_{0.05}P_{0.125}B_{0.05}Si_{0.025}$ | 0.948 | 0.8 |
| 2 | $Pt_{0.75}Cu_{0.035}Ni_{0.015}P_{0.125}B_{0.05}Si_{0.025}$ | 0.947 | 0.7 |
| 3 | $Pt_{0.75}Cu_{0.035}Pd_{0.015}P_{0.125}B_{0.05}Si_{0.025}$ | 0.942 | 0.6 |
| 4 | $Pt_{0.75}Cu_{0.025}Ni_{0.02}Pd_{0.005}P_{0.125}B_{0.05}Si_{0.025}$ | 0.946 | 0.8 |
| 5 | $Pt_{0.75}Cu_{0.025}Ni_{0.02}Cr_{0.005}P_{0.125}B_{0.05}Si_{0.025}$ | 0.947 | 0.5 |
| 6 | $Pt_{0.75}Cu_{0.02}Ni_{0.02}Pd_{0.005}Ag_{0.005}P_{0.125}B_{0.05}Si_{0.025}$ | 0.944 | 0.9 |
| 7 | $Pt_{0.75}Cu_{0.02}Ni_{0.02}Pd_{0.005}Co_{0.005}P_{0.125}B_{0.05}Si_{0.025}$ | 0.946 | 0.6 |
| 8 | $Pt_{0.75}Cu_{0.015}Ni_{0.02}Pd_{0.005}Ag_{0.005}Ag_{0.005}P_{0.125}B_{0.05}Si_{0.025}$ | 0.940 | 0.8 |
| 9 | $Pt_{0.75}Cu_{0.015}Ni_{0.02}Pd_{0.005}Ag_{0.005}Fe_{0.005}P_{0.125}B_{0.05}Si_{0.025}$ | 0.944 | 0.7 |
| 10 | $Pt_{0.73125}Cu_{0.0195}Ni_{0.0195}Pd_{0.004875}Ag_{0.004875}P_{0.115}B_{0.09}Si_{0.015}$ | 0.944 | 1.3 |
| 11 | $Pt_{0.73125}Cu_{0.0195}Ni_{0.0195}Pd_{0.004875}Ag_{0.004875}P_{0.1725}B_{0.02}Si_{0.0275}$ | 0.937 | 1.4 |
| 12 | $Pt_{0.73125}Cu_{0.0195}Ni_{0.0195}Pd_{0.004875}Ag_{0.004875}P_{0.14}B_{0.04}Si_{0.04}$ | 0.939 | 1.4 |
| 13 | $Pt_{0.73125}Cu_{0.0195}Ni_{0.0195}Pd_{0.004875}Ag_{0.004875}P_{0.17}B_{0.04}Si_{0.01}$ | 0.938 | 1.3 |
| 14 | $Pt_{0.71125}Cu_{0.0195}Ni_{0.0195}Pd_{0.004875}Ag_{0.004875}P_{0.185}B_{0.04}Si_{0.015}$ | 0.932 | 0.5 |
| 15 | $Pt_{0.765}P_{0.18}B_{0.04}Si_{0.015}$ | 0.962 | 0.5 |
| 16 | $Pt_{0.7435}Cu_{0.0215}P_{0.18}B_{0.04}Si_{0.015}$ | 0.949 | 1.4 |
| 17 | $Pt_{0.7425}Cu_{0.0125}Ni_{0.01}P_{0.18}B_{0.04}Si_{0.015}$ | 0.949 | 1.3 |
| 18 | $Pt_{0.7456}Cu_{0.0159}Ag_{0.0035}P_{0.18}B_{0.04}Si_{0.015}$ | 0.949 | 2.0 |
| 19 | $Pt_{0.744}Cu_{0.015}Ni_{0.004}Ag_{0.002}P_{0.18}B_{0.04}Si_{0.015}$ | 0.949 | 1.6 |
| 20 | $Pt_{0.745}Cu_{0.013}Ni_{0.003}Pd_{0.002}Ag_{0.002}P_{0.18}B_{0.04}Si_{0.015}$ | 0.949 | 1.5 |
| 21 | $Pt_{0.747}Cu_{0.015}Ag_{0.003}P_{0.18}B_{0.04}Si_{0.015}$ | 0.950 | 1.7 |
| 22 | $Pt_{0.71625}Cu_{0.0195}Ni_{0.0195}Pd_{0.004875}Ag_{0.004875}P_{0.18}B_{0.04}Si_{0.015}$ | 0.934 | 2.7 |
| 23 | $Pt_{0.7}Cu_{0.055}Ag_{0.01}P_{0.18}B_{0.04}Si_{0.015}$ | 0.925 | >4.0 |
| 24 | $Pt_{0.745}Cu_{0.02}P_{0.18}B_{0.04}Si_{0.015}$ | 0.950 | 1.3 |

TABLE 2

| Comparative Example | Alloy Composition | Pt Weight Fraction | d [mm] |
|---|---|---|---|
| 1 | $Pt_{0.80}P_{0.20}$ | 0.962 | <0.5 |
| 2 | $Pt_{0.775}Si_{0.225}$ | 0.959 | <0.5 |
| 3 | $Pt_{0.71}B_{0.29}$ | 0.978 | <0.5 |
| 4 | $Pt_{0.76}P_{0.20}B_{0.04}$ | 0.957 | <0.5 |
| 5 | $Pt_{0.80}P_{0.125}Si_{0.075}$ | 0.963 | <0.5 |
| 6 | $Pt_{0.75}Si_{0.20}B_{0.05}$ | 0.960 | <0.5 |
| 7 | $Pt_{0.71}Cu_{0.06}Si_{0.23}$ | 0.931 | <0.5 |
| 8 | $Pt_{0.71}Ni_{0.06}Si_{0.23}$ | 0.933 | <0.5 |
| 9 | $Pt_{0.71}Cu_{0.06}Si_{0.23}$ | 0.937 | <0.5 |
| 10 | $Pt_{0.73}Ag_{0.03}Si_{0.16}P_{0.06}Ge_{0.02}$ | 0.928 | <0.5 |
| 11 | $Pt_{0.75}Cr_{0.05}P_{0.20}$ | 0.943 | <0.5 |
| 12 | $Pt_{0.65}Ni_{0.09}B_{0.26}$ | 0.940 | <0.5 |
| 13 | $Pt_{0.75}Ni_{0.05}B_{0.05}P_{0.15}$ | 0.947 | <0.5 |

By way of example, some thermodynamic and mechanical properties of the alloys prepared according to Examples 15, 21, 23 and 24 are reported in Table 3. In Table 3, $T_g$ is the glass transition temperature (at 20° C./min heating rate), $T_x$ is the crystallization temperature (at 20° C./min heating rate), $T_s$ is the solidus temperature, $T_l$ is the liquidus temperature, $\Delta H_x$ is the enthalpy of crystallization, $\Delta H_f$ is the enthalpy of fusion, and $\Delta H_V$ is the Vickers hardness.

TABLE 3

| | Example 15 | Example 21 | Example 23 | Example 24 |
|---|---|---|---|---|
| Pt wt. fraction | 0.962 | 0.950 | 0.925 | 0.950 |
| d [mm] | 0.5 | 1.7 | >4 | 1.3 |
| $T_g$ [° C.] | 201 | 207 | 220 | 208 |
| $T_x$ [° C.] | 238 | 256 | 254 | 255 |
| $T_s$ [° C.] | 557 | 552 | 562 | 555 |
| $T_l$ [° C.] | 584 | 589 | 609 | 592 |
| $\Delta H_x$ [J/g] | 50.8 | 56.6 | 56.8 | 56.4 |
| $\Delta H_f$ [J/g] | 76.0 | 76.4 | 81.0 | 75.1 |
| $H_v$ [kgf/mm$^2$] | — | 395 | — | — |

Metallic glasses are formed by way of rapid cooling, which avoids crystallization and instead freezes the material in a liquid-like atomic configuration (i.e. a glassy state). Alloys with good glass forming ability are those able to form bulk objects (with the smallest dimension being greater than about 1 mm) having a fully amorphous phase using standard available cooling techniques. For a given alloy, the critical casting rod diameter (d) is defined as the largest diameter of a fully amorphous rod that can be formed using standard available cooling techniques, and is a measure of the glass forming ability of the alloy.

As shown in Tables 1 and 2, the alloys prepared according to Comparative Examples 1-13 having non-metal or metalloid alloying elements including only P, only Si, only B, P and B, P and Si or Si and B (i.e., not including all three of P, Si and B) achieved inadequate critical casting thicknesses. In particular, although each of these Comparative Examples Pt weight fractions of 0.928 or above, the critical casting thicknesses achieved by these alloys was less than 0.5 mm. As noted above, the critical casting thickness is a measure of glass forming ability, and the failure of the alloys of the Comparative Examples to achieve adequate critical casting thicknesses shows that these alloys have poor glass forming ability. As such, these alloys are not suitable for practical applications, and are certainly not suitable for use in jewelry applications or similar applications requiring good processability and glass forming ability.

Figure 1B:
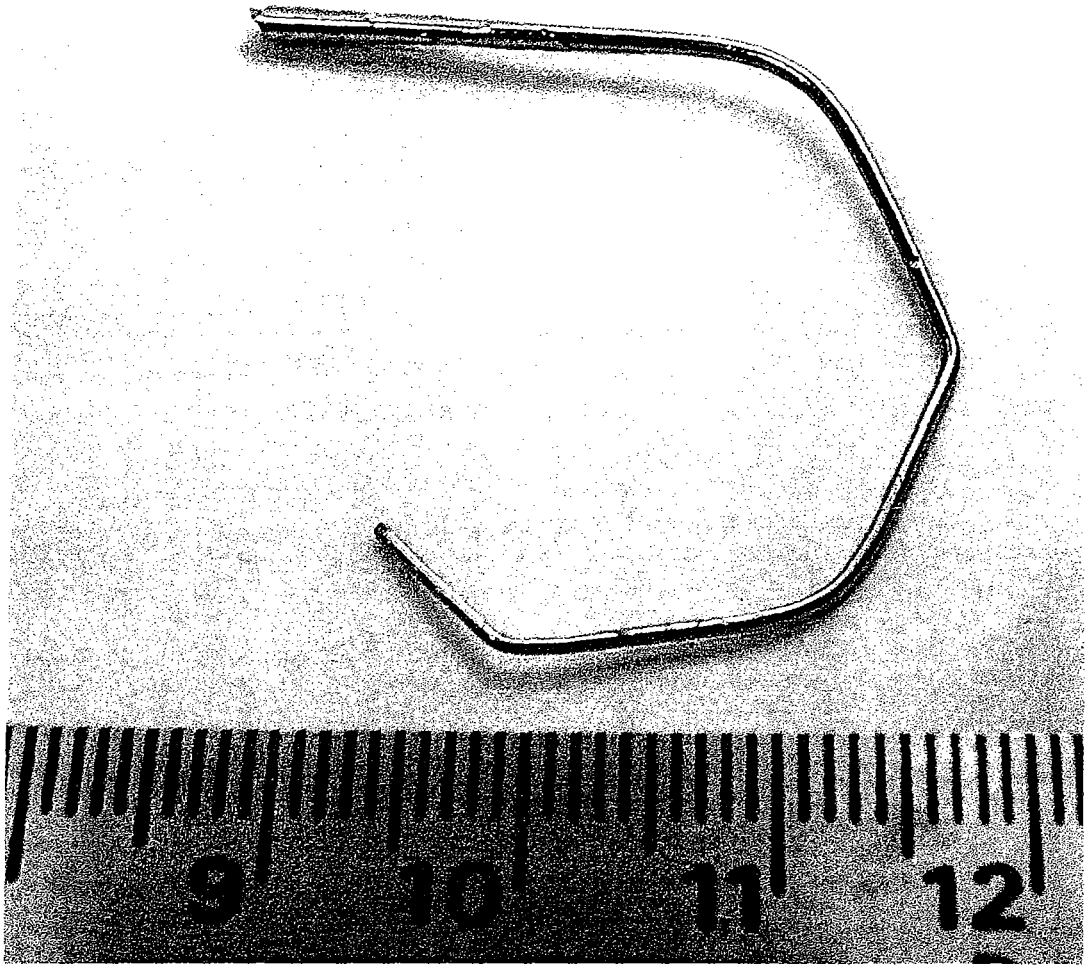
FIG. 1B is a photograph of a plastically bent $Pt_{0.747}Cu_{0.015}Ag_{0.003}P_{0.18}B_{0.04}Si_{0.015}$ rod.

In contrast to the alloys produced from the Comparative Examples, the alloys made from the Examples shown in Table 2 all achieved Pt weight fractions of about 0.925 or above, and critical casting thicknesses of about 0.5 mm or above. Indeed, some of these alloys achieved critical casting thicknesses exponentially greater than those achieved by the alloys of the Comparative Examples. For example, FIG. 1A shows an amorphous $Pt_{0.747}Cu_{0.015}Ag_{0.003}P_{0.18}B_{0.04}Si_{0.015}$ rods produced according to Example 21 and having a 1.7 mm diameter. In addition, FIG. 1B shows a plastically bent amorphous $Pt_{0.747}Cu_{0.015}Ag_{0.003}P_{0.18}B_{0.04}Si_{0.015}$ rod, showing that the rods are not brittle. Accordingly, the alloys according to embodiments of the present invention not only achieve higher Pt content, they also have good glass forming ability, a trait that is essential for practical applications, such as jewelry and other applications requiring both processability and high Pt contents.

The combination of high Pt content and good glass forming ability appears to be attributable to the particular combination of non-metal and metalloid alloying elements in the alloys according to embodiments of the present invention. Specifically, the use of all three of P, Si and B enables the increase in Pt content without completely degrading glass forming ability. In contrast, alloys including only one or two of these elements in the alloy formula do not achieve the same results. As shown in Table 2, alloys including only one or two of P, Si and B do not achieve a critical casting thickness suitable for practical applications no matter which one or two of these elements is used. However, as shown in Table 1, alloys produced according to embodiments of the present invention, including all three of P, Si and B achieve not only high Pt content, but also exponentially greater critical casting thicknesses, making them suitable for many practical applications, including jewelry and other applications requiring both processability and high Pt content.

Figure 2:
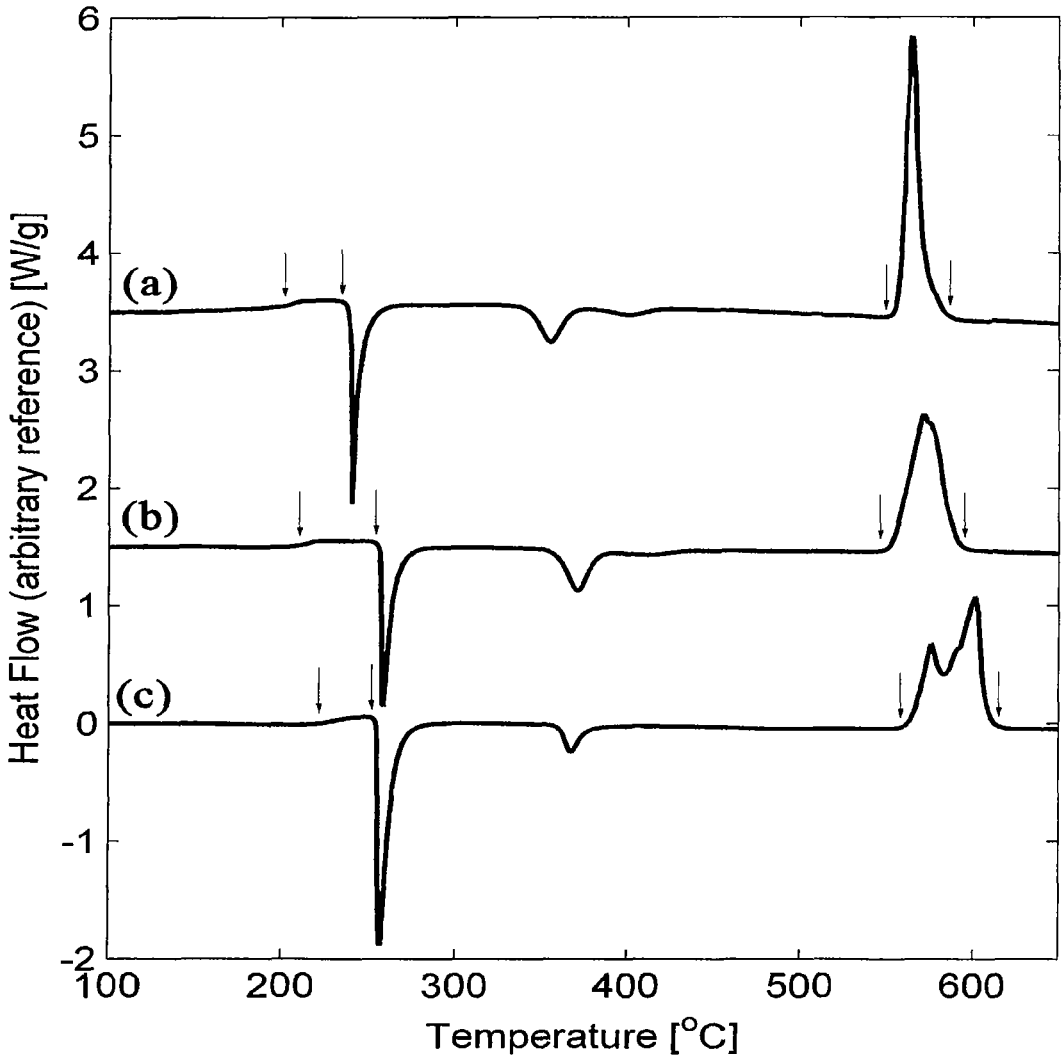
FIG. 2 is a graph comparing the calorimetry scans of different alloys with the following compositions: (a) $Pt_{0.765}P_{0.18}B_{0.04}Si_{0.015}$ prepared according to Example 15, (b) $Pt_{0.747}Cu_{0.015}Ag_{0.003}P_{0.18}B_{0.04}Si_{0.015}$ prepared according to Example 21, and (c) $Pt_{0.7}Cu_{0.055}Ag_{0.01}P_{0.18}B_{0.04}Si_{0.015}$ prepared according to Example 23. The arrows in each scan designate, from left to right, the glass-transition, crystallization, solidus, and liquidus temperatures for each alloy.

The amorphous nature of the compositions of the Examples and Comparative Examples reported in Tables 1 and 2 were investigated using at least one of X-ray diffraction analysis and differential scanning calorimetry. FIG. 2 compares the calorimetry scans of the compositions of Example 15 (a), Example 21 (b), and Example 23 (c). In FIG. 2, the glass transition, crystallization, solidus, and liquidus temperatures for each alloy are indicated with arrows.

While the present invention has been illustrated and described with reference to certain exemplary embodiments, those of ordinary skill in the art will understand that various modifications and changes may be made to the described embodiments without departing from the spirit and scope of the present invention, as defined in the following claims.

What is claimed is:

1. A method of manufacturing a bulk metallic glass object comprising:

melting a metallic alloy comprising at least Pt, P, Si and B as alloying elements, wherein the Pt is present in the alloy at a weight fraction of about 0.925 or greater, and wherein the alloy is configured to form the bulk metallic glass object having a thickness of at least 0.5 mm into a molten state to form a molten metallic alloy; and quenching the molten metallic alloy at a cooling rate sufficiently rapid to prevent crystallization of the alloy.

2. The method of claim 1, further comprising fluxing the molten alloy prior to quenching by using a reducing agent.

3. The method of claim 2, wherein the reducing agent comprises dehydrated boron oxide ($B_2O_3$) melt.

4. The method of claim 1, the step of melting the metallic alloy comprising melting the metallic alloy at a temperature of at least 100° C. above the liquidus temperature of the alloy.

5. The method of claim 1, the step of quenching the molten metallic alloy comprising quenching the molten alloy in a quartz tube by water.

6. The method of claim 5, wherein the quartz tube has an outer diameter of about 20% larger than an inner diameter.

7. The method of claim 5, wherein the quartz tube has wall thickness equal to about 10% of thickness of the bulk metallic glass object.

8. The method of claim 1, further comprising forming an amorphous rod of the alloy with a diameter of at least 0.5 mm, the rod being able to be plastically bent.

9. The method of claim 1, wherein the bulk metallic glass object comprises a jewelry.

10. The method of claim 1, wherein the alloy comprises an additional alloying element selected from the group consisting of Cu, Ag, Ni, Pd, Au, Co, Fe, Ru, Rh, Ir, Re, Os, Sb, Ge, Ga, Al, and combinations thereof.

11. The method of claim 10, wherein the Cu is present in an atomic fraction of about 0.015 to about 0.025, the P is present in the alloy in an atomic fraction of about 0.15 to about 0.185, the B is present in the alloy in an atomic fraction of about 0.02 to about 0.06, and the Si is present in the alloy in an atomic fraction of about 0.005 to about 0.025.

12. The method of claim 10, wherein the atomic ratio of Cu to Ag present in the alloy ranges from about 2 to about 10.

13. The method of claim 12, wherein the Cu is present in the alloy in an atomic fraction of about 0.01 to about 0.02, the Ag is present in the alloy in an atomic fraction of about 0.001 to about 0.01, the P is present in the alloy in an atomic fraction of about 0.15 to about 0.185, the B is present in the alloy in an atomic fraction of about 0.02 to about 0.06, and the Si is present in the alloy in an atomic fraction of about 0.005 to about 0.025.

14. The method of claim 1, wherein the Pt is present in the alloy in a weight fraction of about 0.950 or greater.

15. The method of claim 1, wherein the P is present in an atomic fraction ranging from about 0.10 to about 0.20.

16. The method of claim 1, wherein the B is present in an atomic fraction ranging from about 0.01 to about 0.10.

17. The method of claim 1, wherein the Si is present in an atomic fraction ranging from about 0.005 to about 0.05.

18. The method of claim 1, wherein the alloy comprises an alloy selected from the group consisting of $Pt_{0.765}P_{0.18}B_{0.04}Si_{0.015}$, $Pt_{0.745}Cu_{0.02}P_{0.18}B_{0.04}Si_{0.015}$, $Pt_{0.7435}Cu_{0.0215}P_{0.18}B_{0.04}Si_{0.015}$, $Pt_{0.7425}Cu_{0.0125}Ni_{0.01}P_{0.18}B_{0.04}Si_{0.015}$, $Pt_{0.7456}Cu_{0.0159}Ag_{0.0035}P_{0.18}B_{0.04}Si_{0.015}$, $Pt_{0.744}Cu_{0.015}Ni_{0.004}Ag_{0.002}P_{0.18}B_{0.04}$Si.su-b.$_{0.015}$, $Pt_{0.745}Cu_{0.013}Ni_{0.003}Pd_{0.002}Ag_{0.002}P_{\cdot 0.18}B_{0.04}Si_{0.015}$, $Pt_{0.747}Cu_{0.015}Ag_{0.003}P_{0.18}B_{0.04}Si_{0.015}$, $Pt_{0.71625}Cu_{0.0195}Ni_{0.0195}Pd_{0.004875}Ag_{0.004875}P_{0.18}B_{0.04}Si_{0.015}$, $Pt_{0.7}Cu_{0.055}Ag_{0.01}P_{0.18}B_{0.04}Si_{0.015}$, $Pt_{0.75}Cu_{0.05}P_{0.125}B_{0.05}Si_{0.025}$, $Pt_{0.75}Cu_{0.035}Ni_{0.015}P_{0.125}B_{0.05}Si_{0.025}$, $Pt_{0.75}Cu_{0.035}Pd_{0.015}P_{0.125}B_{0.05}Si_{0.025}$, $Pt_{0.75}Cu_{0.025}Ni_{0.02}Pd_{0.005}P_{0.125}B_{0.05}Si_{0.025}$, $Pt_{0.75}Cu_{0.025}Ni_{0.02}Cr_{0.005}P_{0.125}B_{0.0\text{-}5}Si_{0.025}$, $Pt_{0.75}Cu_{0.02}Ni_{0.02}Pd_{0.005}Ag_{0.005}P_{0.125}B_{0.05}Si_{0.025}$, $Pt_{0.75}Cu_{0.02}Ni_{0.02}Pd_{0.005}CO_{0.005}P_{0.125}B_{0.05}Si_{0.025}$, $Pt_{0.75}Cu_{0.015}Ni_{0.02}Pd_{0.005}Ag_{0.005}Au_{0.005}P_{0.125}B_{0.05}Si_{0.025}$, $Pt_{0.75}Cu_{0.015}Ni_{0.02}Pd_{0.005}Ag_{0.005}Pe_{0.005}P_{0.125}B_{0.05}Si_{0.025}$, $Pt_{0.73125}Cu_{0.0195}Ni_{0.0195}Pd_{0.004875}Ag_{0.004875}P_{0.115}B_{0.09}Si_{0.015}$, $Pt_{0.73125}Cu_{0.0195}Ni_{0.0195}Pd_{0.004875}Ag_{0.004875}P_{0.1725}B_{0.02}Si_{0.0275}$, $Pt_{0.73125}Cu_{0.0195}Ni_{0.0195}Pd_{0.004875}Ag_{0.004875}P_{0.14}B_{0.04}Si_{0.04}$, $Pt_{0.73125}Cu_{0.0195}Ni_{0.0195}Pd_{0.004875}Ag_{0.004875}P_{0.17}B_{0.04}Si_{0.01}$, $Pt_{0.71125}Cu_{0.0195}Ni_{0.0195}Pd_{0.004875}Ag_{0.004875}P_{0.185}B_{0.04}Si_{0.015}$, wherein the subscripts denotes approximate atomic fractions.

19. The method of claim 1, wherein the alloy comprises an alloy selected from the group consisting of $Pt_{0.765}P_{0.18}B_{0.04}Si_{0.015}$, $Pt_{0.745}Cu_{0.02}P_{0.18}B_{0.04}Si_{0.015}$, $Pt_{0.7435}Cu_{0.0215}P_{0.18}B_{0.04}Si_{0.015}$, $Pt_{0.7425}Cu_{0.0125}Ni_{0.01}P_{0.18}B_{0.04}Si_{0.015}$, $Pt_{0.7456}Cu_{0.0159}Ag_{0.0035}P_{0.18}B_{0.04}Si_{0.015}$, $Pt_{0.744}Cu_{0.015}Ni_{0.004}Ag_{0.002}P_{0.18}B_{0.04}$Si-su-b.$_{0.015}$, $Pt_{0.745}Cu_{0.013}Ni_{0.003}Pd_{0.002}Ag_{0.002}P_{\cdot 0.18}B_{0.04}Si_{0.015}$, $Pt_{0.747}Cu_{0.015}Ag_{0.003}P_{0.18}B_{0.04}Si_{0.015}$, $Pt_{0.71625}Cu_{0.0195}Ni_{0.0195}Pd_{0.004875}Ag_{0.004875}P_{0.18}B_{0.04}Si_{0.015}$, $Pt_{0.7}Cu_{0.055}Ag_{0.01}P_{0.18}B_{0.04}Si_{0.015}$, wherein the subscripts denote approximate atomic fractions.

20. The method of claim 1, wherein the alloy comprises an alloy selected from the group consisting of $Pt_{0.765}P_{0.18}B_{0.04}Si_{0.015}$, $Pt_{0.747}Cu_{0.015}Ag_{0.003}P_{0.18}B_{0.04}Si_{0.015}$, $Pt_{0.745}Cu_{0.02}P_{0.18}B_{0.04}Si_{0.015}$, and $Pt_{0.7}Cu_{0.055}Ag_{0.01}P_{0.18}B_{0.04}Si_{0.015}$, wherein the subscripts denote approximate atomic fractions.

* * * * *